United States Patent [19]

Ujiie et al.

[11] Patent Number: 4,567,937

[45] Date of Patent: Feb. 4, 1986

[54] ELECTROMAGNETIC STIRRING METHOD AND DEVICE FOR DOUBLE CASTING TYPE CONTINUOUS CASTING APPARATUS

[75] Inventors: Yoshitaro Ujiie; Hirobumi Maede; Mitsugi Okazaki; Yoshimitsu Kashiwakura, all of Hokkaido, Japan

[73] Assignee: Nippon Steel Corporation, Tokyo, Japan

[21] Appl. No.: 644,654

[22] Filed: Aug. 27, 1984

Related U.S. Application Data

[63] Continuation of Ser. No. 389,486, Jun. 17, 1982, abandoned.

[30] Foreign Application Priority Data

Jun. 20, 1981 [JP] Japan ..... 56-94565

[51] Int. Cl.[4] ..... B22D 11/00

[52] U.S. Cl. ..... 164/504; 164/468

[58] Field of Search ..... 164/468, 499, 504, 147.1

[56] References Cited

U.S. PATENT DOCUMENTS 4,331,196 5/1982 Ohashi ..... 164/468

FOREIGN PATENT DOCUMENTS 0013441 7/1980 European Pat. Off. ..... 164/504

*Primary Examiner*—Nicholas P. Godici
*Assistant Examiner*—Richard F. Seidel
*Attorney, Agent, or Firm*—Cushman, Darby & Cushman

[57] ABSTRACT

A method and a device for electromagnetic stirring in a double casting type continuous steel casting apparatus using a pair of linear motor type electromagnetic stirring units opposing to each other, which are arranged in front and in rear of a plurality of cast steel pieces in such a way as to straddle them. The magnetic poles of these stirring units are caused either to move in the same direction in a reciprocal motion, for example, from the left to the right and vice versa or to circulate in the same direction from one of the opposed unit to the other.

1 Claim, 5 Drawing Figures

ELECTROMAGNETIC STIRRING METHOD AND DEVICE FOR DOUBLE CASTING TYPE CONTINUOUS CASTING APPARATUS

This is a continuation of Ser. No. 389,486 filed June 17, 1982 now abandoned.

BACKGROUND OF THE INVENTION

1. Field of the Invention

This invention relates to a method and a device for electromagnetic stirring in a continuous steel casting process arranged to withdraw a plurality of cast pieces of steel simultaneously in parallel through pairs of opposing pinch rolls (hereinafter will be called a double casting type continuous casting process).

2. Description of the Prior Art

Cast pieces of steel obtained through a continuous casting process are in most cases supplied to subsequent rolling processes as rolling materials. Generally, in integrated steel making plants or electric furnace steel making works of a large scale, where comprehensive manufacture of steel materials is performed, a plurality of rolling mills are usually equipped. The rolling materials to be processed at such plants or works include various kinds of materials such as slabs, blooms, billets, etc. Further, the progresses made in the continuous casting technology has resulted in an increased productivity of continuous casting machines. To utilize the increased productivity to a full extent, it is desirable to have various kinds of rolling materials such as slabs, blooms and billets supplied from a single continuous casting machine. In view of this, a double casting type continuous casting process has been put in practice to withdraw a plurality of cast pieces simultaneously in parallel through pairs of opposing pinch rolls.

Meanwhile, in the continuous casting process, it has long been known to carry out electromagnetic stirring to prevent the occurrence of dendrite and the segregation of impurities within the cast steel pieces in a liquidus-solidus state such as slabs or blooms by controlling solidification of the slabs or blooms with the stirring operation as disclosed, for example, in U.S. Pat. No. 3,656,537 and in Japanese Utility Model Publication No. Sho 52-52893.

In carrying out the electromagnetic stirring in the double casting type continuous casting process, installation of an electromagnetic stirring device for every cast piece presents a problem, because there are a plurality of cast pieces drawn through the pairs of opposing pinch rolls. More specifically, widening the space distance between one cast piece and another for installing one unit of the electromagnetic stirring device for each of them necessitates use of longer rolls for supporting cast pieces. This is not desirable from the aspect of economy. Besides, in the case of the double casting type continuous casting process, cast pieces of different shapes such as slabs and blooms are cast in different numbers according to their shapes, for example, in such a way as to simultaneously cast one slab and two blooms all together. Therefore, arrangements to provide one unit of the electromagnetic stirring device for every cast piece necessitate alteration of these units of the electromagnetic stirring device every time the shape and the number of the cast pieces to be passed through the same pinch rolls are changed. Such arrangements, therefore, require a long period of time for mounting and dismounting the electromagnetic stirring devices.

The length of the obstraction time incidental to alteration of the shape of the cast pieces lowers the rate of operation of the double casting type continuous casting apparatus. Such arrangements are therefore uneconomical also in that respect.

SUMMARY OF THE INVENTION

It is therefore an object of the present invention to provide a method for electromagnetic stirring which eliminates the above stated shortcomings of the conventional method by arranging a pair of linear motor type electromagnetic stirring devices in such a way as to straddle a plurality of cast pieces being drawn in parallel.

It is another object of the present invention to provide an electromagnetic stirring device which obviates the necessitity of widening the distance between a plurality of parallel cast pieces and also obviates the necessity of replacing one electromagnetic stirring device unit with another at the time of every change in the shape of the cast pieces, so that the rate of operation of the double casting type continuous stirring device can be increased.

The inventors of the present invention have studied the effects of stirring attainable where the linear motor type electromagnetic device is arranged in the manner as mentioned above. As a result of the study, the following findings have been made:

Where two cast pieces, for example, are to be simultaneously cast in a continuous manner with these cast pieces spaced in parallel with each other, when a pair of linear motor type stirrer units are installed in front and in rear of the two cast pieces in such a way as to straddle them and their magnetic poles are caused to move, for example, from the left to the right, the distribution of the magnetic flux density becomes as shown in FIG. 3. As shown, there is a tendency that the magnetic flux density becomes low on the left side and high on the right side. If the steel piece is a single piece of continuous molten steel, the fluidic movement of the molten steel due to an electromagnetic energy within the steel piece would take place throughout the whole steel piece, so that a homogeneous stirring effect can be obtained in spite of the salient inclination of the magnetic flux density distribution toward the right.

However, in cases where a plurality of molten steel pieces separated from each other are to be simultaneously stirred as in the case of the present invention, the steel pieces are not continuous from each other. Hence, the fluidic movement of the molten steel caused by the electro magnetic energy is limited to each of them. As a result of that, even if a high magnetic flux density appears in the steel piece on the right side, the stirring effect thus obtained is limited to the steel piece on the right-hand side while the steel piece on the left side is not thoroughly stirred. In an attempt to solve this problem, the inventors of the present invention conducted various studies and found that this problem can be solved by arranging an opposed pair of linear motor type electro magnetic stirring units so as either to move their magnetic poles in the same directions, for example, first from the right to the left and vice versa or to let the magnetic pole and make this reciprocal motion at least once as schematically shown in FIG. 4A or to have the magnetic poles rotated in the same direction from one of the units to the other as schematically shown in FIG. 4B. This finding has led to the present invention.

The linear motor type electromagnetic stirring device used in the present invention permits utilization of the conventionally known devices. Further, the magnetic poles also can be moved in accordance with the conventional method.

These objects, features and advantages of the present invention will become apparent from the following detailed description of preferred embodiments thereof taken in connection with the accompanying drawings.

BRIEF DESCRIPTION OF THE DRAWINGS

FIG. 4A representing a parallel reciprocating stirring mode and

FIG. 4B representing a circulating flow stirring mode.

DETAILED DESCRIPTION OF PREFERRED EMBODIMENTS

Figure 1A:
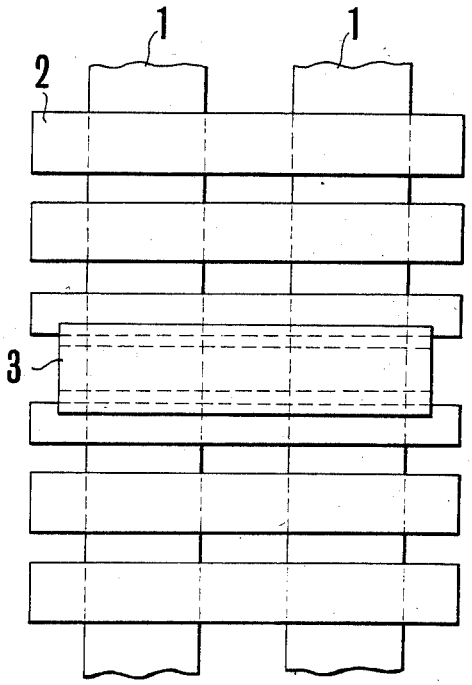
FIGS. 1A and 1B are a plan view and a side view showing an embodiment of the present invention.
Figure 1B:
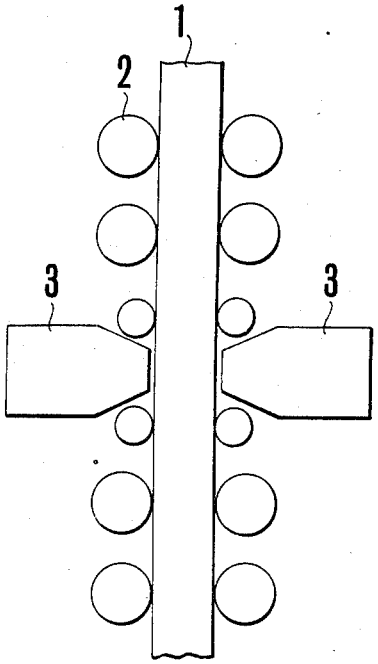

An embodiment of the present invention wherein two cast pieces are arranged to be simultaneously withdrawn is as shown in FIG. 1. This embodiment comprises a pair of units of a linear motor type electromagnetic stirring device 3, which are arranged between cast piece supporting rolls 2 in such a way as to straddle two cast pieces 1. In the case of this arrangement, the cast pieces are preferably spaced closer, because the electromagnetic energy will be nullified to a less degree with the cast pieces spaced close to each other. This meets the economic requirement of a double casting type continuous casting apparatus calling for making the length of the cast piece supporting rolls as short as possible.

Further, in casting the cast pieces into varied shapes, the cast piece must be supported from four directions at a very short distance immediately below the mold. In changing the shape of the cast piece from a slab to a bloom, the rolls must be also replaced with different rolls. However, at a further distance in the withdrawing direction, the cast piece can be sufficiently supported only from two directions. Accordingly, the change of shape of the cast pieces does not necessitate replacement of the supporting rolls and the rolls in use can be used in common with varied shapes of cast pieces in a part of the path of the cast piece at a further distance from the mold. Assuming that this part is called a common zone, the electromagnetic stirring device of the linear motor type is installed in the common zone. Then, each unit of the device can be used in common with varied shapes of the cast pieces without replacing it with another unit.

In using the electromaqnetic stirring device, a problem has been noted that the driving force for stirring decreases to a great extent when the cast piece is in a very narrow shape. To solve this problem, it has been found necessary to reduce the distance between poles in such a case.

Figure 2:
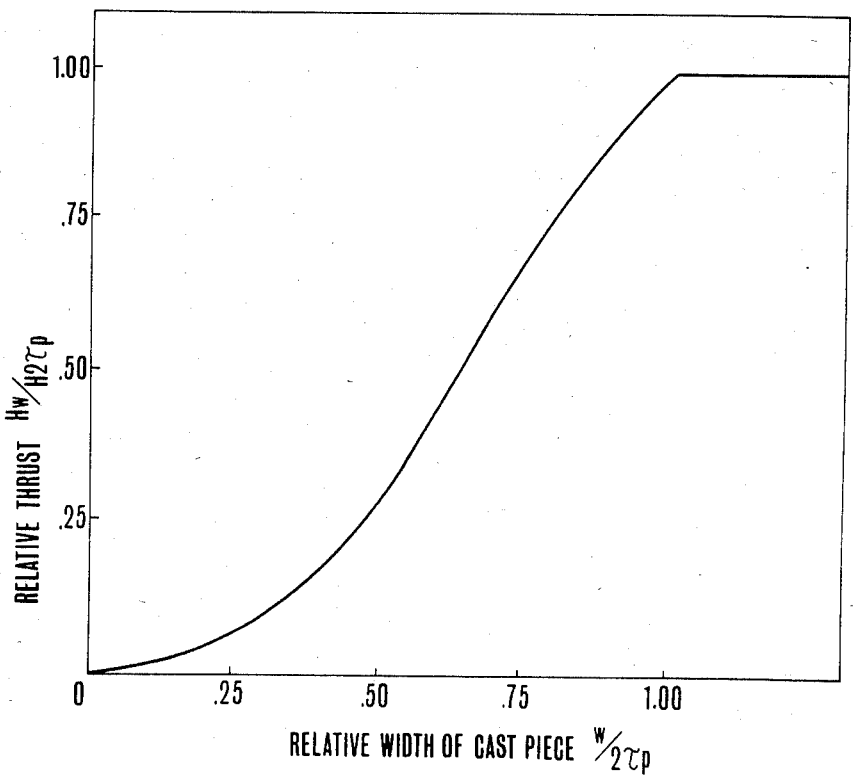
FIG. 2 is a graph showing the relation of the width of a cast piece to thrust.
Figure 3:
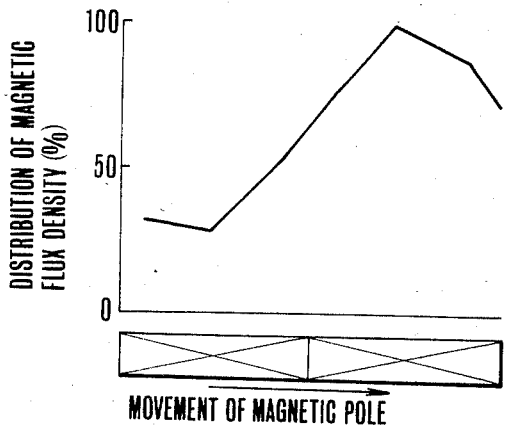
FIG. 3 is a graph showing magnetic flux density distribution within the cast piece varying according as magnetic poles move.
Figure 4:
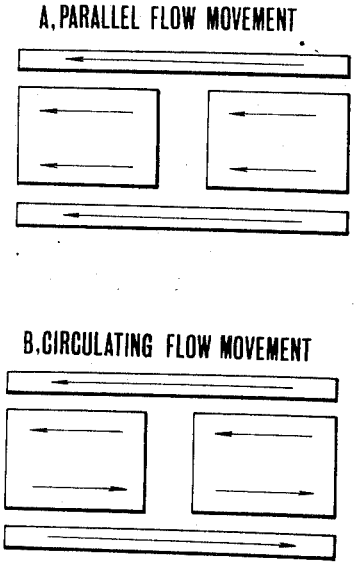
FIGS. 4A and 4B are schematic illustrations of methods for moving magnetic poles.

The relation of the stirring thrust to the width of the cast piece is as shown in FIG. 2. In FIG. 2, the axis of abscissa of the graph indicates the ratio of the width (w) of the cast piece to the length ($2\tau_p$) occupied by four poles which form a minimum constituent unit of the linear motor type electromagnetic stirring device. The axis of ordinate of the graph indicates the ratio of the stirring thrust (Hw) for the width (w) of a cast piece to stirring thrust ($H2\tau_p$) obtained when the width of the cast piece is equal to the length ($2\tau_p$) of two poles. It is apparent from this graph that a stirring effect is hardly obtainable at $w/2\ \tau_p \leqq 0.20$. It is therefore desirable to select the value of $\tau_p$ in such a way as to satisfy the following relation:

$$\tau_p \leqq 2.5\ w \qquad \ldots (1)$$

Further the stirring thrust saturates at $w/2\ \tau_p$. Therefore, any increase in the thrust cannot be expected from the following relation:

$$\tau_p < 0.5\ w \qquad \ldots (2)$$

The relation represented by formula (2) above merely results in nothing more than the technical difficulty for shortening the distance between the poles. In view of that, it is preferable to have the relation of:

$$\tau_p \geqq 0.5\ w \qquad \ldots (3)$$

Considering formulas (1) and (3) together, the relation of the pole spacing distance $\tau_p$ is preferably arranged to satisfy the following relation:

$$0.5\ w \leqq \tau_p \leqq 2.5\ w \qquad \ldots (4)$$

To further illustrate this invention, and not by way of limitation, the following examples are given.

In a double casting type continuous casting apparatus adapted to cast two cast pieces of bloom each measuring 350×560 mm, a linear motor type electromagnetic stirring device which had two poles arranged to have $\tau_p = 720$ mm was installed in accordance with the present invention. This double casting type continuous casting apparatus was arranged also to be capable of casting sometimes one slab measuring 350×1300 mm. The electromagnetic stirring device was installed in a common zone horizontally extending for processing both the slab and the blooms. As a result of this, it was possible to have the body length of the cast piece supporting rolls arranged to be not exceeding 1600 mm.

For casting the blooms, it was possible to obtain a thrust of 20 mm Fe (as converted into pressure), with which the segregation taking place in the center portion of the bloom became completely negligible. Further, the stirring device could be used also for the slab in common with the bloom. In the case of the slab, a thrust of 120 mm Fe could be obtained and the central segregation in the slab could be improved also to a completely negligible extent.

Further, blooms of low-carbon Al-Si killed steel, medium carbon Al-Si killed steel and high carbon Al-Si, and slabs of medium Al-Si killed steel were continuously cast by a slab-bloom double casting type continuous casting machine equipped with electromagnetic stirring devices.

The size of the blooms was 350 mm in thickness, 560 mm in width, and the casting was done with two blooms simultaneously located accross the same pinch rolls, while the casting of the slabs was done with a single slab located accross the pinch rolls.

The casting speed was in the range of from 0.5 m/min. to 1.0 m/min. and the casting temperature was controlled as such the temperature of the molten steel in the tandish was in the range of from the melting point +10° C. to the melting point +40° C.

The electromagnetic stirring device was a two-pole linear-motor type with a pole pitch of 720 mm and operable at a maximum current of 800 A×2. The stirring devices were arranged in the horizontal common zone on the casting machine in two rows spaced 4 m from each other with the upper device being arranged just below the mold. The stirring was done in the circulating flow mode and in the parallel reciprocating flow mode for the bloom casting.

Subsequently to the bloom casting, the slab casting was performed with the same continuous casting machine with the same electromagnetic stirring machine with necessary replacement of molds and other necessary parts. The stirring for the slab casting was done in the parallel reciprocating flow mode.

Test pieces of 50 mm in length (casting direction) were taken by gas cutting from the blooms and slabs thus obtained at the portions corresponding to their intermediate casting stage.

The gas cut surfaces of the test pieces were ground 10 mm to 15 mm by milling cutter and polished mirror finished, subjected to sulfur printing and macro corrosion tests to determine the internal conditions of the castings such as central segregations and negative segregations.

Table 1 shows the internal condition of the blooms obtained by the circulating flow stirring.

In Table 1, the bloom A and the bloom B which were obtained by simultaneously casting two blooms in parallel across the same pinch rolls are compared with respect to their internal qualities. There is no substantial difference between these blooms and both blooms show satisfactory internal qualities due to the central segragation reducing effect. Smaller numerical figures under the items of estimation of the central segregation, and the negative segregation indicate better qualities.

Table 2 shows the internal qualities of the blooms of high-carbon Al-Si killed steel obtained by the parallel reciprocating flow stirring.

As clearly demonstrated in Table 2, both of the blooms A and B which were simultaneously cast show very satisfactory internal qualities without no substantial difference.

For comparison, the internal qualities of blooms obtained by the parallel one-way stirring (No. 6 to No. 10) are shown in Table 2. Due to the stronger movement of molten steel in the bloom A than in the bloom B, there is a remarkable difference in the internal qualities between the blooms A and B; namely the bloom A shows better central segregation estimation but worse negative segregation than the bloom B. That, it is practically impossible to control both the central segregation and the negative segregation within a predetermined range when two blooms are simultaneously cast by the parallel one-way stirring.

Meanwhile, blooms of medium-carbon Al-Si killed steel could be obtained with very satisfactory central segregation estimation ranging from 0 to 1.0 by the parallel reciprocating stirring.

With the invention applied to a double casting type continuous casting apparatus as described in the foregoing, electromagnetic stirring becomes possible without widening the spacing between cast pieces. When the shape of the cast piece is changed, the invention permits use of the electromagnetic stirring device in common with the cast piece of a different shape. Besides, the problem of middle segregation the solution of which is one of the purposes of electromagnetic stirring can be effectively solved in accordance with the present invention.

TABLE 1

| | | | | Bloom A | | Bloom B | |
|---|---|---|---|---|---|---|---|
| Steel Grade | C % | Casting Speed (m/min) | Stirring Current (A) | Central Segregation Estimation | Negative Segregation Estimation | Central Segregation Estimation | Negative Segregation Estimation |
| Low- | 0.17 | 0.72 | | 1.0 | 0.5 | 1.0 | 0.5 |
| Carbon | 0.17 | 0.57 | $400^A \times 2$ | 1.0 | 0.5 | 1.0 | 0.5 |
| Al—Si | 0.15 | 0.94 | | 0.5 | 0.5 | 0.5 | 1.0 |
| Killed | 0.20 | 0.74 | | 0.5 | 0.5 | 0.5 | 0.5 |
| Steel | 0.18 | 0.90 | $600^A \times 2$ | 0.5 | 1.0 | 0.5 | 1.0 |
| | 0.17 | 0.50 | | 1.0 | 0.5 | 1.0 | 0.5 |
| | 0.17 | 0.83 | | 0 | 1.0 | 0 | 1.0 |
| | 0.18 | 0.65 | $800^A \times 2$ | 0.5 | 0.5 | 0 | 1.0 |
| | 0.20 | 1.00 | | 0 | 1.5 | 0 | 1.5 |
| Medium- | 0.40 | 0.61 | | 0.5 | 0.5 | 0.5 | 0.5 |
| Carbon | 0.39 | 0.55 | $400^A \times 2$ | 0.5 | 0.5 | 0.5 | 0.5 |
| Al—Si | 0.40 | 0.90 | | 0.5 | 1.0 | 0.5 | 0.5 |
| Killed | 0.43 | 0.58 | | 0.5 | 1.0 | 0.5 | 1.0 |
| Steel | 0.38 | 0.70 | $600^A \times 2$ | 0 | 1.0 | 0.5 | 0.5 |
| | 0.38 | 0.55 | | 0.5 | 0.5 | 0.5 | 0.5 |
| | 0.38 | 0.81 | | 0 | 1.0 | 0 | 1.0 |
| | 0.40 | 0.92 | $800^A \times 2$ | 0 | 1.5 | 0 | 1.5 |
| | 0.41 | 0.57 | | 0 | 1.0 | 0.5 | 0.5 |
| High- | 0.52 | 0.97 | | 0.5 | 1.5 | 0.5 | 1.5 |
| Carbon | 0.50 | 0.52 | $400^A \times 2$ | 1.0 | 0.5 | 1.0 | 0.5 |
| Al—Si | 0.53 | 0.77 | | 1.0 | 0.5 | 1.0 | 0.5 |
| Killed | 0.53 | 0.65 | | 0.5 | 1.0 | 0.5 | 1.0 |
| Steel | 0.54 | 0.68 | $600^A \times 2$ | 1.0 | 0.5 | 1.0 | 0.5 |
| | 0.50 | 0.85 | | 0 | 1.5 | 0 | 1.5 |
| | 0.48 | 0.85 | | 0.5 | 1.0 | 0.5 | 0.5 |
| | 0.52 | 0.99 | $800^A \times 2$ | 0 | 1.5 | 0.5 | 1.0 |
| | 0.51 | 0.52 | | 0 | 1.5 | 0 | 1.5 |

TABLE 2

| Steel No. | C % | Casting Speed (m/min) | Stirring Current (A) | Stirring Mode (Parallel) | Cycle of Recipro-cation (sec) | Bloom A Central Segregation Estimation | Bloom A Negative Segregation Estimation | Bloom B Central Segregation Estimation | Bloom B Negative Segregation Estimation |
|---|---|---|---|---|---|---|---|---|---|
| 1 | 0.52 | 0.55 | | Reciprocating | 40" | 1.5 | 0.5 | 1.5 | 0 |
| 2 | 0.54 | 0.90 | $600^A \times 2$ | " | 40" | 0.5 | 1.5 | 0.5 | 1.5 |
| 3 | 0.51 | 0.68 | | " | 120" | 1.0 | 0.5 | 1.0 | 0.5 |
| 4 | 0.52 | 0.85 | | " | 120" | 1.0 | 0.5 | 1.0 | 0.5 |
| 5 | 0.53 | 0.90 | | " | 120" | 0.5 | 1.0 | 0.5 | 1.0 |
| 6 | 0.52 | 0.55 | | One-way | — | 0.5 | 1.0 | 1.5 | 0 |
| 7 | 0.54 | 0.90 | | " | — | 0 | 1.5 | 0.5 | 1.0 |
| 8 | 0.51 | 0.68 | $600^A \times 2$ | " | — | 0.5 | 1.0 | 1.5 | 0.5 |
| 9 | 0.52 | 0.85 | | " | — | 0.5 | 1.0 | 1.5 | 0.5 |
| 10 | 0.53 | 0.90 | | " | — | 0 | 1.5 | 2.0 | 0.5 |

What we claim:

1. In a molding apparatus of the type having a pair of molds, each for casting an article, said molds having a predetermined overall width for casting articles where the cast articles will move along a path, electromagnetic stirring apparatus located downstream of said molds, said stirring apparatus comprising a plurality of linear motor type electromagnetic stirrers, a pair of said stirrers being disposed, opposing each other, one on one side and the other on the opposite side of said path for at least two cast pieces with each of said stirrers of said pair extending over the cast pieces in such a way as to straddle both of said pieces, each of said stirrers being disposed so as to satisfy the following condition:

$$0.5w \leqq \tau_p \leqq 2.5w;$$

wherein w represents the width of said molds and $\tau_p$ represents the pole pitch of the stirrers.

* * * * *